US005470243A

United States Patent [19]

Bendorf

[11] Patent Number: 5,470,243

[45] Date of Patent: Nov. 28, 1995

[54] ELECTRICAL CONNECTOR WITH SNORTING SWITCH

[75] Inventor: Robert L. Bendorf, Millerstown, Pa.

[73] Assignee: The Whitaker Corporation, Wilmington, Del.

[21] Appl. No.: 198,798

[22] Filed: Feb. 17, 1994

[51] Int. Cl.[6] ..... H01R 29/00

[52] U.S. Cl. ..... 439/188; 439/513

[58] Field of Search ..... 439/188, 513

[56] References Cited

U.S. PATENT DOCUMENTS

| | | | |
|---|---|---|---|
| 4,070,557 | 1/1978 | Ostapovitch | 200/51.1 |
| 4,179,173 | 12/1979 | Rise, III | 439/188 |
| 4,224,486 | 9/1980 | Zimmerman, Jr. et al. | 200/51.1 |
| 5,071,362 | 12/1991 | Martens et al. | 439/188 |
| 5,077,851 | 4/1991 | Matsumoto | 439/188 |
| 5,229,187 | 7/1993 | McGinn . | |
| 5,259,776 | 11/1993 | Giroux | 439/188 |
| 5,266,043 | 11/1993 | Giroux et al. | 439/188 |
| 5,277,606 | 1/1994 | Giroux et al. | 439/188 |
| 5,277,607 | 1/1994 | Thumma et al. | 439/188 |

FOREIGN PATENT DOCUMENTS

93/15535 8/1993 WIPO .

*Primary Examiner*—Kenneth J. Ramsey

[57] ABSTRACT

An electrical connector 10 is disclosed having a shorting switch 30 that shorts connector contacts 14 together when the mating connector 90 is separated therefrom and breaks the short when the mating connector 90 is mated thereto. The shorting switch 30 includes a shank 32 that is secured in an opening 24 in the base 16 of the connector housing 12. A first beam 38 extends upwardly from the shank 32 at an angle thereto and terminates in a radiused end 40 on one side of the centerline 37 of the shank 32. A second beam 42 extends from the radiused end 40 and terminates in a bifurcated contact end 50,52 on the other side of the shank centerline 37. The second beam 42 includes a knee 48 which is engaged by the mating connector housing 92 for camming the contact end 50,52 out of shorting engagement with the connector contacts 14 in such a way that the contact end 50,52 remains spaced from the mating housing 92. Elongated openings 54,56,58 are formed in the first and second beams 38,42 to distribute the stress of mating and unmating among the first and second beams 38,42 and the radiused end 40.

15 Claims, 8 Drawing Sheets

ELECTRICAL CONNECTOR WITH SNORTING SWITCH

The present invention is related to mating electrical connector halves having a shorting switch that shorts connector contacts together when the two halves are separated and breaks the short when the two halves are mated.

BACKGROUND OF THE INVENTION

Certain electrical equipment, such as computers, that utilize a backplane or motherboard and have daughterboards that plug into electrical connectors mounted on the motherboard, also require that certain signal or power contacts, hereinafter signal contacts, of one of the connectors be shorted together when disconnecting the daughterboard from that connector. This sometimes allows the reminder of the equipment to continue to operate until the daughterboard is subsequently replaced. This shorting together of the contacts is accomplished by means of a shorting switch element that is either part of the connector or is part of the motherboard. An example of the latter type is disclosed in U.S. Pat. No. 4,179,173 which issued Dec. 18, 1979 to Rise, III. The '173 patent discloses a printed circuit board having an array of contact pins extending from a major surface thereof and a receptacle connector that mates with these pins. A pair of shorting switch elements are shown near one end of the array of contact pins secured to the circuit board. Each of the shorting elements includes contacts that engage two adjacent contact pins of the array when the connector is unmated from the board and that are disengaged from the contact pins when the connector is mated. An example of the first type is disclosed in U.S. Pat. No. 5,017,362 which issued Dec. 10, 1991 to Martens et al. The '362 patent discloses mating receptacle and plug connector halves wherein the receptacle housing includes a shorting element that shorts together adjacent contacts when the plug is removed from the receptacle and that disengages the contacts when the plug is mated to the receptacle. In this structure, the contact pins of the plug engage portions of the shorting element thereby deflecting it out of shorting engagement with the receptacle contacts when the plug is inserted. A potential problem with this is that the plug contacts that carry the signals are used to engage the shorting element thereby tending to wear and perhaps adversely affect the fragile contacting surface of the signal contact. Similar designs are disclosed in U.S. Pat. Nos. 5,259,776 to Giroux and 5,266,043 to Giroux and Mendenhall issued Nov. 9, 1993, and Nov. 30, 1993. Another example of the first type is disclosed in U.S. Pat. No. 4,070,557 which issued Jan. 24, 1978 to Ostapovitch. The '557 patent discloses mating plug and receptacle connector halves having a shorting element arranged within the plug housing. The shorting element is attached to the interior of one of the side walls of the plug housing and extends outwardly to engage the connector contacts that are to be shorted. When the receptacle is mated to the plug, a corner edge of the receptacle housing engages the shorting element thereby deflecting it away from the plug contacts. During this mating, the receptacle housing does not actually engage the point of the shorting element that contacts the signal contacts, however, it does come very close to doing so. As the receptacle is mated with the plug, the edge of the receptacle housing engages and then slides along a beam potion of the shorting element and then into engagement with the rounded end of the element that comprises the contact that engages the signal contacts. This tends to wear and eventually damage the delicate surface of the shorting element and, perhaps adversely affect the point of contact between the shorting element and the signal contacts.

What is needed is a shorting element that can be positioned within a connector housing without regard to the walls of the housing and that is deflected out of shorting engagement with the signal contacts without adversely affecting the point of contact of either the shorting element or of the signal contacts themselves. Additionally, the deflection of the shorting element out of shorting engagement with the signal contacts should occur prior to mating of the receptacle and plug signal contacts.

SUMMARY OF THE INVENTION

An electrical connector is disclosed including an insulating housing having a base, at least one row of signal contacts extending upwardly from the base for mating engagement with contacts of a mating connector. The signal contacts extend through the base and terminate in leads for electrically connecting to another electrical component. The mating connector also has an insulating housing. The disclosed connector has a shorting switch that includes a shank secured to the base of the connector housing, the shank having an axis substantially parallel with the axes of the signal contacts. A first beam extends from the shank at an angle to the axis away from the signal contacts and terminates in a radiused end at least partially on one side of the axis. A second beam extends from the radiused end across the axis and terminates in a contact end positioned on the other side of the axis. The shorting switch is arranged so that when the connector and the mating connector are separated the contact end is in shorting engagement with at least two of the signal contacts and when the connector and the mating connector are mated the contact end is spaced from the signal contacts and from both of the connector housings.

DESCRIPTION OF THE PREFERRED EMBODIMENT

Figures 1, 2:
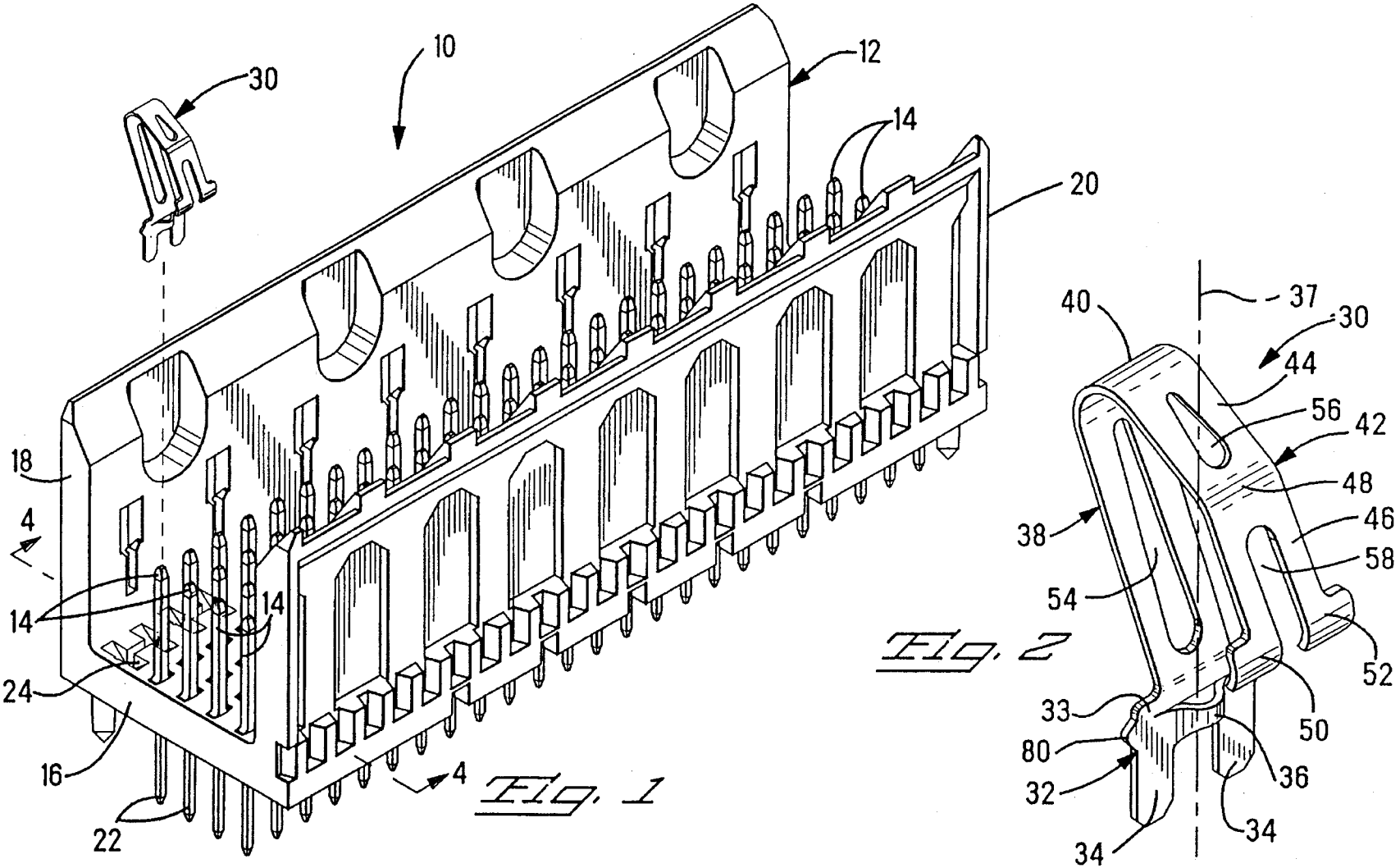
FIG. 1 is an isometric view of an electrical connector incorporating the teachings of the present invention.
FIG. 2 is an isometric view of the shorting contact shown in FIG. 1.
Figure 3:
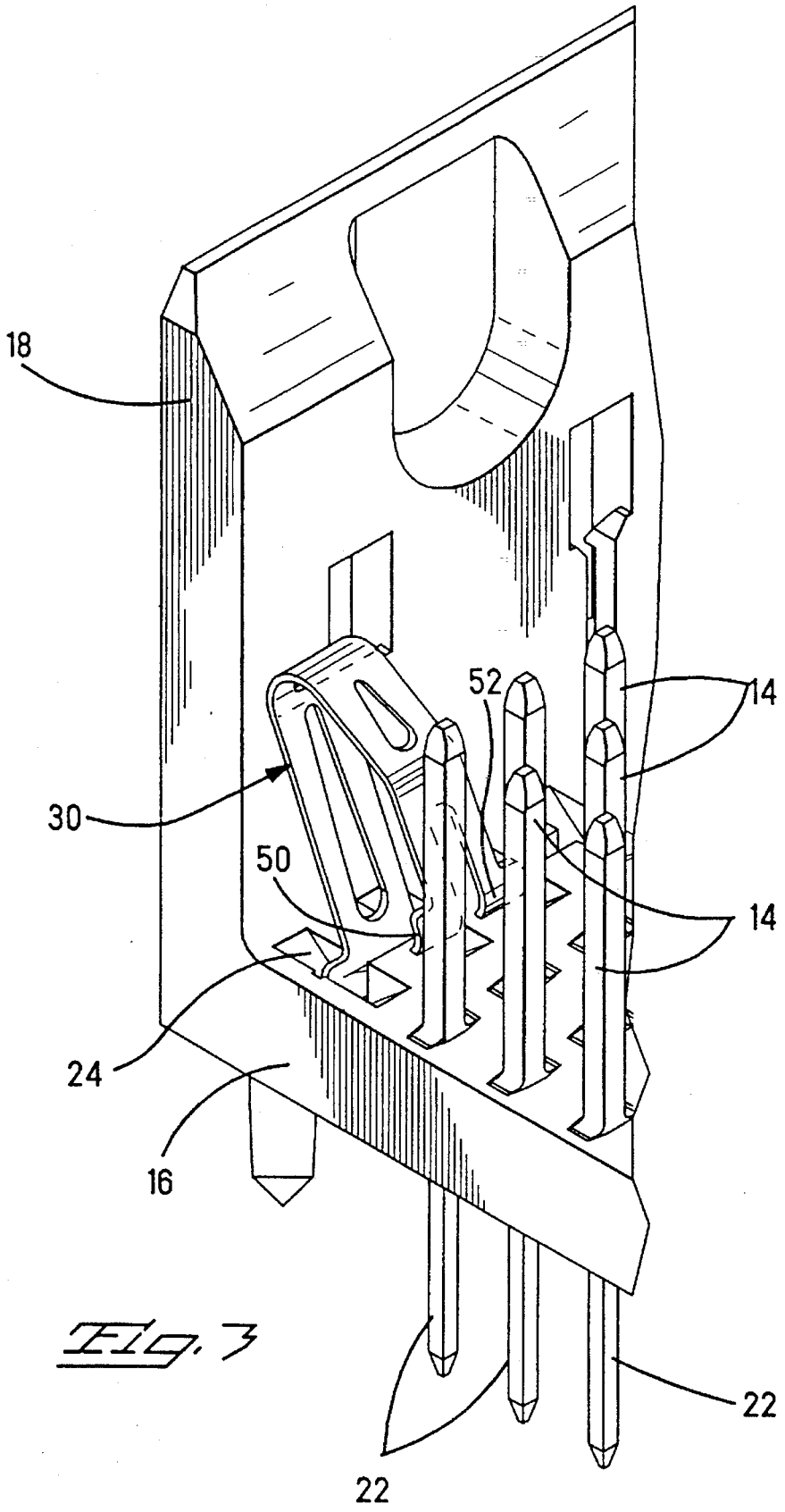
FIG. 3 is an enlarged view of a portion of the view of FIG. 1 showing the shorting contact in place.
Figure 4:
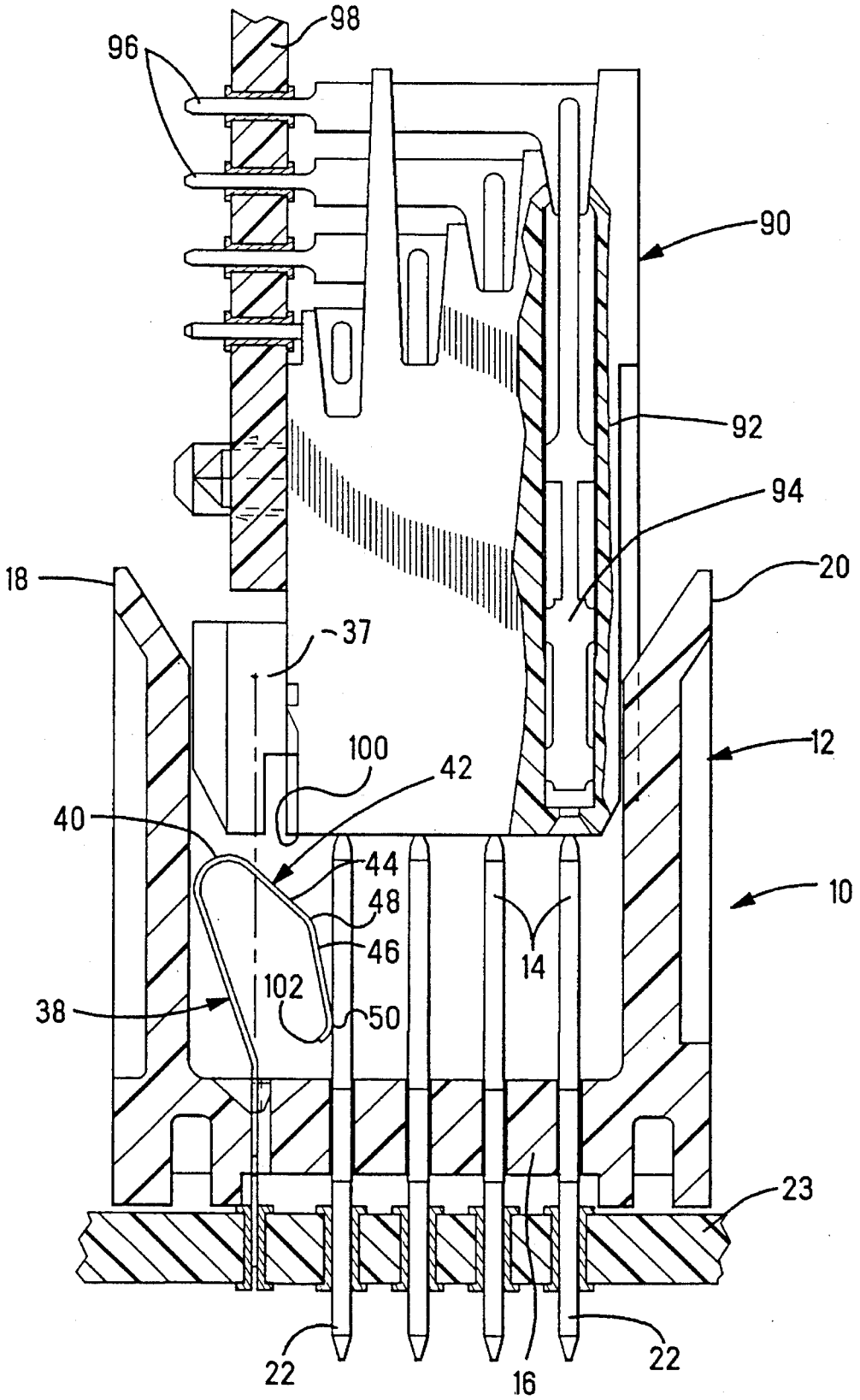
FIG. 4 is cross-sectional view taken along the lines 4–4 in FIG. 1.

There is shown in FIG. 1 an electrical connector 10 having an insulating housing 12 and four rows of pin shaped contacts 14 which are usually signal contacts but some may also be used to provide power. The connector housing 12 includes a base 16 and a pair of vertically disposed side walls 18 and 20 extending from the base, the walls being on opposite sides of the four rows of pin contacts 14. The pin contacts 14 extend through the base 16 and terminate in leads 22 that are arranged to be electrically connected to circuitry on a circuit board 23, as shown in FIG. 4. A plurality of openings are formed in the base adjacent the side wall 18 for receiving one or more shorting switch elements 30. The shorting switch element 30, as shown in FIG. 2, includes a shank 32 having a body 33 and two spaced apart legs 34 extending from the body. A dimple 36, or projection extends from the body laterally of the legs and substantially between them as shown. The shank 32 has a vertical centerline 37, as best seen in FIGS. 1, 2, and 4, that is substantially parallel with the longitudinal centerlines of the pin contacts 14 when the shank is in position within an opening 24, as shown in FIG. 3. As best seen in FIGS. 2 and 4, the shorting switch element 30 includes a first beam 38 that extends upwardly from the shank 32 at an angle thereto in a direction away from the pin contacts 14 and terminates in a radiused end 40. The major portion of the radiused end 40 is positioned substantially to the left of the centerline 37, as viewed in FIG. 4. A second beam 42 extends away from the radiused end 40 and includes a first portion 44 and a second portion 46 joined at a knee 48. The first portion 44 diverges away from the first beam 38 while the second portion 46 is angled away from the plane of the first portion 44 in the direction of the shank 32 so that the knee 48 extends away from the first beam 38, as best seen in FIG. 4. The second portion 46 terminates in a bifurcated contact end having two contact ends 50 and 52 that are spaced on the same spacing as the pin contacts 14 in the row adjacent the side wall 18. First and second elongated openings 54 and 56 are formed in the first and second beams, 38,42 respectively, to help to distribute and balance stress between the two beams and the radiused end 40 that occur during operation of the shorting switch 30. A third elongated opening 58 is formed in the second portion 46 of the second beam 42 that serves to bifurcate the contact end and to assure substantially equal contact force when the two contacts 50,52 are in engagement with two pin contacts 14, as shown in FIG. 3.

Figures 5, 6, 7:
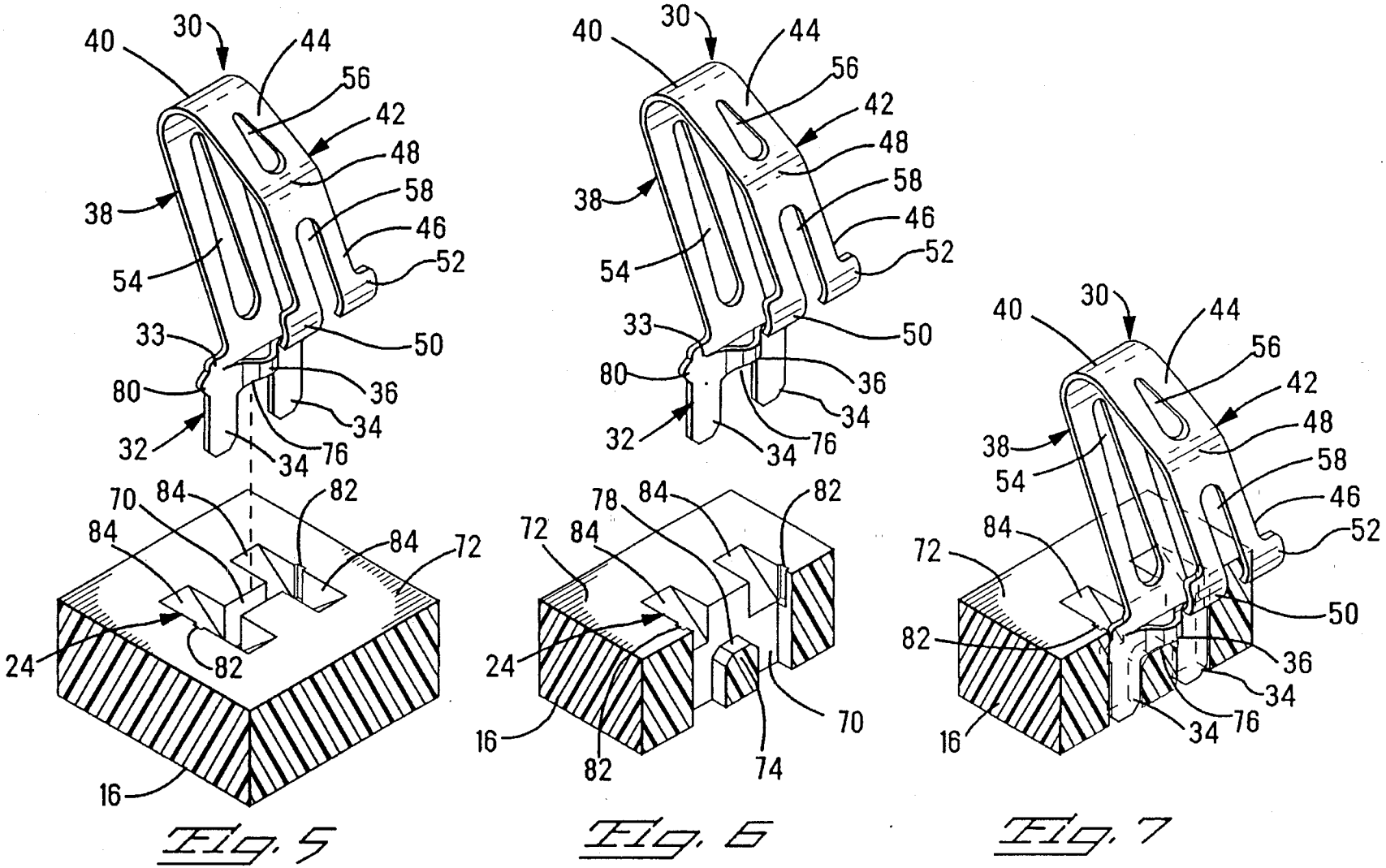
FIG. 5 is an isometric view of the shorting switch element and a portion of the base showing the opening that receives the switch element.
FIG. 6 is similar to the view of FIG. 5 showing the opening partially cut away.
FIG. 7 is similar to the view of FIG. 6 showing the switch element in position within the opening.

Each of the openings 24 in the base 16 of the insulated housing 12, as best seen in FIGS. 5, 6, and 7, includes a slot 70 that is formed into the top surface 72 of the base 16. A center bridge 74 extends across the center of the slot 70 and is straddled by the two legs 34 when the shank 32 is in position, as shown in FIGS. 3 and 7. In this position, the lower edge 76 of the dimple 36 is seated on the top 78 of the bridge 74. A pair of barbs 80 extend outwardly from opposite ends of the body 33 and interferingly engage grooves 82 formed into the walls of opposite ends of the slot 70 when the shank is forced thereinto, thereby securing the shorting switch element 30 to the base 16. The dimple 36 projects outwardly from the body 33 of the shank 32 so that it interferes with the wall of the slot 70 as it is being inserted therein. The dimple 36 tends to flatten somewhat thereby causing the lower portion of the body 33 to lengthen and the two legs 34 to spread apart and interferingly engage the end walls of the opening 70. This same action causes the barbs 80 to take a deeper bite in the end walls as well. All of this enhances the securing of the shank 32 to the base 16. As best seen in FIGS. 5, 6, and 7, the opening 24 includes chamfers 84 that provide lead in to the opening for the legs 34 during insertion of the shank 32 into the slot 70.

Figure 8:
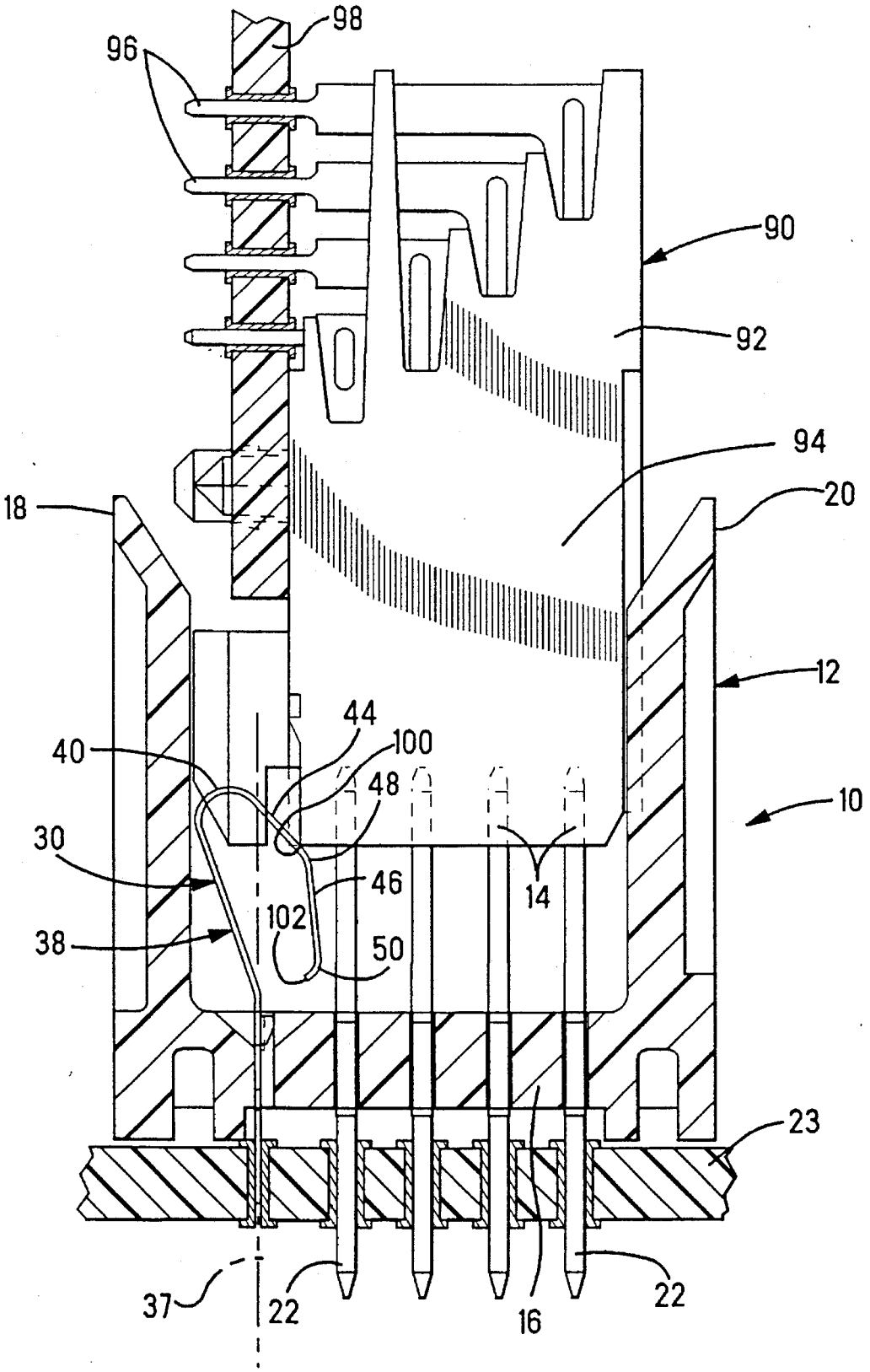
FIGS. 8, 9, and 10 are cross-sectional views similar to that of FIG. 4 showing the two connectors in various stages of mated engagement.
Figure 9:
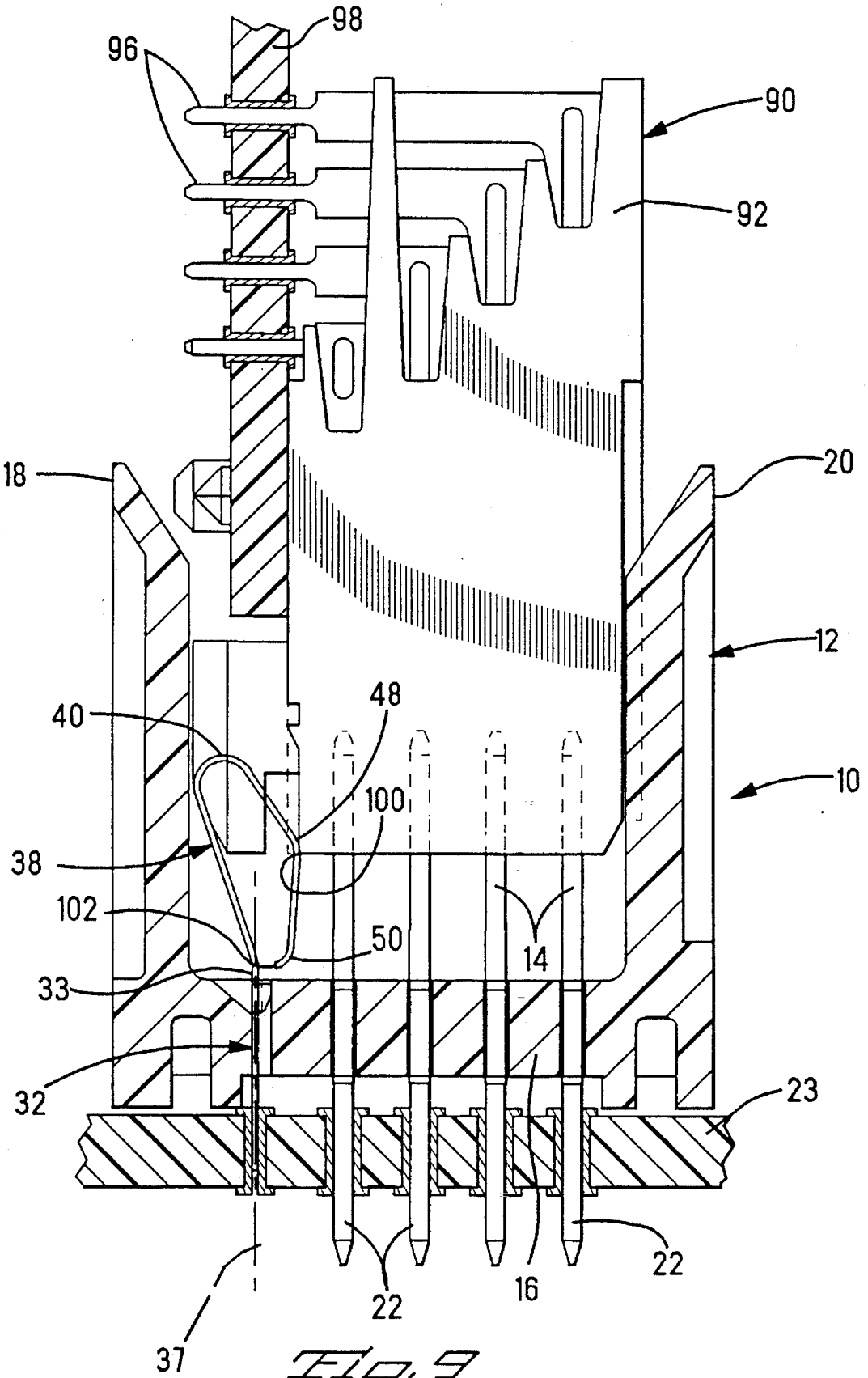
Figure 10:
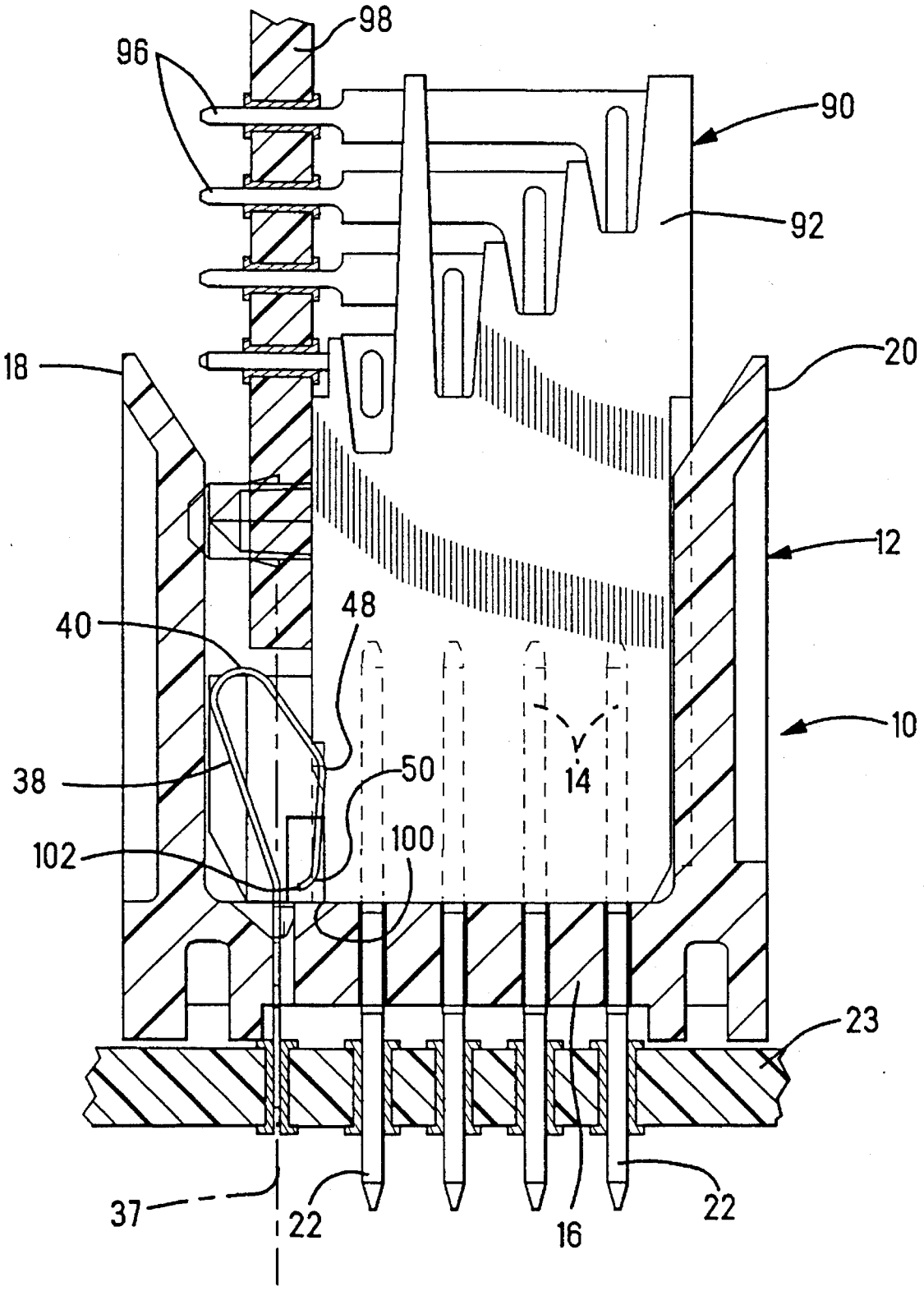

In operation, as shown in FIG. 4, the connector 10 is arranged on the circuit board 23 with its leads 22 in electrical engagement with circuitry thereon. Additionally, the legs 34 of the shorting switch element 30 may be in electrical engagement with appropriate circuitry on the motherboard, as desired. A mating connector 90 having an insulating housing 92 is brought into mating engagement with the connector housing 12. The mating connector 90 has receptacle contacts 94 which mate with the pin contacts 14. The receptacle contacts 94 include leads 96 that electrically engage circuitry on a circuit board 98, which in the present example, is a daughterboard. As the mating connector 90 is inserted further into the connector 10, the lower left corner 100 of the insulating housing engages the first portion 44 of the second beam 42 just above the knee 48 and begins to deflect it toward the first beam 38, as shown in FIG. 8. At this point the shorting contacts 52 have just disengaged the pin contacts 14. As insertion continues the corner 100 rides over the knee 48, deflecting the contact ends 50, 52 to the left, as viewed in FIG. 9, to a point close to the shank 32, and the receptacle contacts 94 begin to engage the pin contacts 14. This break of the shorting switch contacts 50, 52 before mating of the receptacle and pin contacts 94 and 14 is important in certain circuits. Note that the second portion 46 of the second beam 42 is now angled toward the centerline 37 so that the contact ends 50, 52 are closer to the centerline 37 than is the knee 48. This provides clearance between the contact ends 50, 52 and the side of the mating connector housing 92 adjacent the corner 100 when the two connectors are fully mated as shown in FIG. 10. Therefore, during mating and unmating, the corner 100 of the insulating housing 92 engages only the area of the second beam on either side of and very close to the knee 48 leaving most of the length of the second portion 46 and the contact ends 50, 52 spaced from the housing 92. At no time during mating or unmating do the contact ends 50, 52 engage either of the connector housings. As best seen in FIGS. 4 and 10, the shorting switch element 30 includes a turned edge 102 that extends from each of the contact ends 50, 52 toward the shank 32. The length of this turned edge 102 is chosen so that the edge is close to abutting the body 33 of the shank 32 when the two connectors are mated as shown in FIG. 10. In the event that a mating connector 90 having an oversized or otherwise defective housing 92 were mated to the connector 10, the amount of deflection permitted of the shorting element would be limited by the turned edge 102, thereby preventing over stress of the shorting element 30.

While the connector 10, in the present example, is shown with pin contacts 14 that are shorted together by the shorting switch element 30, it will be understood that the teachings of the present invention can be applied to connectors having receptacle contacts that are shorted together.

Figure 12:
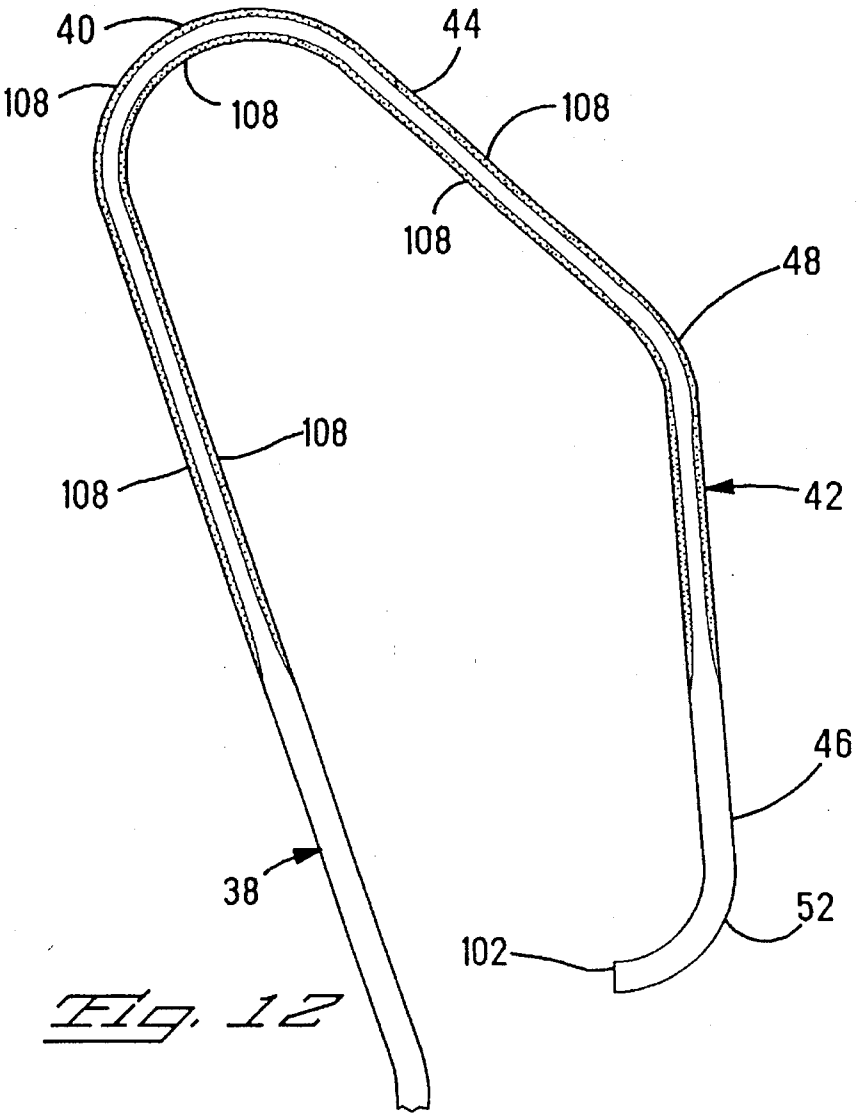
FIG. 12 is an illustration similar to that of FIG. 11 with the elongated openings in the shorting switch element.
Figure 11:
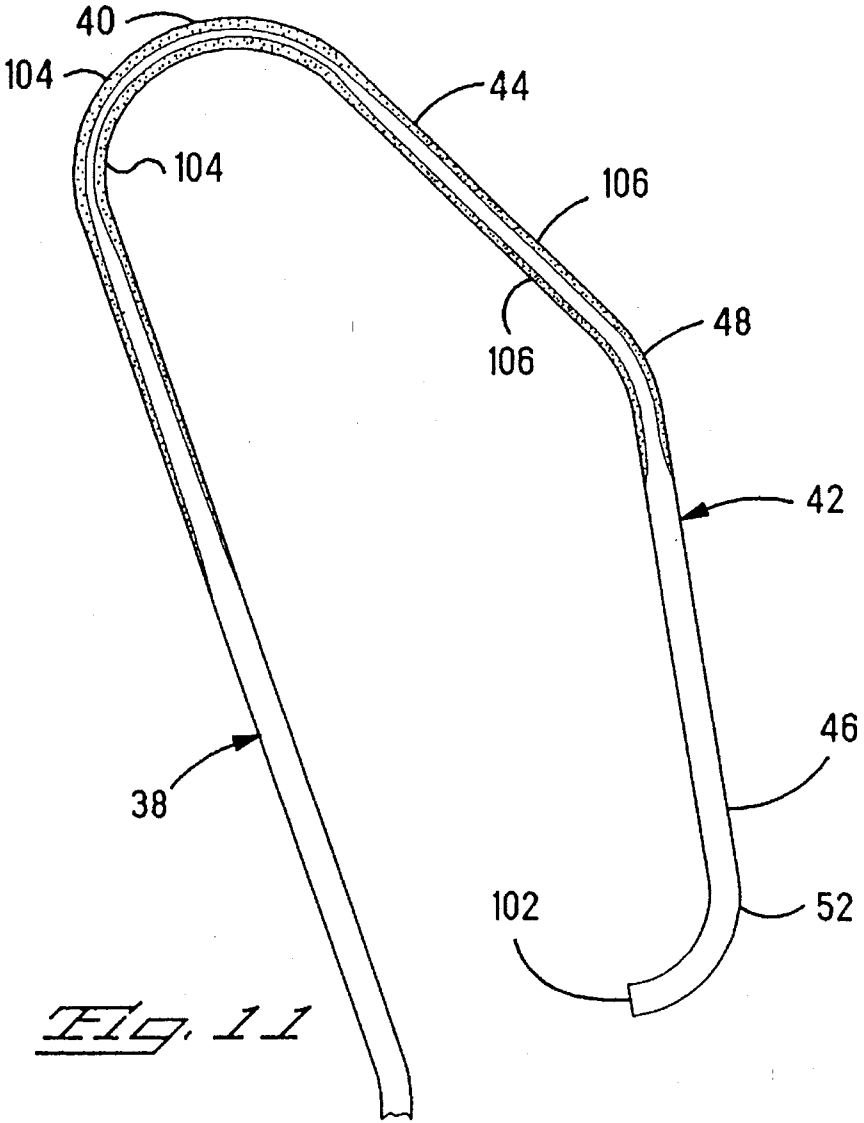
FIG. 11 is an illustration showing operational stress on selected points of the shorting switch element without the elongated openings therein.

The stress on the first and second beams 38 and 42 and the radiused end 40 is illustrated in FIGS. 11 and 12, wherein FIG. 11 shows the distribution of stress without the elongated openings 54 and 56 and FIG. 12 shows the stress distribution with the elongated openings. As seen in FIGS. 11, the material stress is shown in a cross section of the shorting switch contact. The stress is concentrated at the reverse bend area of the radiused end 40 with most of the material thickness in plastic deformation. This stress concentration is indicated by the dark areas 104 that penetrate inwardly from both edges of the material. Note, that a lesser concentration of stress, as indicated by the dark areas 106, continues from the radiused end 40 along the first portion 44 and the knee 48, with the second portion 46 showing very little stress. This undesirable imbalance of stress was greatly improved with the addition of the elongated openings 54, 56, and 58, which distribute stress away from the reverse bend area to adjacent areas. FIG. 12 illustrates the stress distributed over the beams adjacent to and including the reverse bend area by the elongated openings 54, 56, and 58. Note that the stress, indicated by the dark areas 108, extends further along the first beam 38 and along the second portion 46 to about half its length. As is shown, this dark area 108 is relatively uniform in its penetration from both sides into the thickness of the material indicating that the stress is uniformly distributed over this area of the shorting switch element.

An important advantage of the present invention is that the shorting switch element is supported entirely by the base of the connector housing without regard to proximity to a housing wall. The switch element includes a turned edge that positively prevents inadvertent overstressing of the first and second beams and the radiused end during mating and unmating. Additionally, the dimple on the shank causes the legs and barbs to dig into the walls of the opening thereby enhancing the securing of the shank to the base of the connector housing. Another important advantage is that when mating the two connectors the shorting switch contacts are broken before the signal or power contacts are mated and, when unmating the signal and power contacts are broken before the shorting contacts are mated. Additionally, operation of the shorting switch element during mating and unmating does not adversely affect the point of contact of the shorting element due to engagement with the mating connector housing.

We claim:

1. In an electrical connector including an insulating housing having a base, at least one row of signal contacts extending upwardly from said base for mating engagement with contacts of a mating connector having a housing, said signal contacts extending through said base and terminating in leads for electrically connecting to another electrical component, a shorting switch comprising:

(a) a shank secured to said base of said connector housing and having an axis substantially parallel with the axes of said signal contacts;

(b) a first beam extending from said shank at an angle to said axis away from said signal contacts and terminating in a radiused end at least partially on one side of said axis;

(c) a second beam extending from said radiused end across said axis and terminating in a contact end positioned on the other side of said axis; and (d) a turned edge on said contact end arranged so that when said connector and said mating connector are in mated engagement said turned edge is adjacent said shank and is further arranged to abuttingly engage said shank to prevent over stressing of said shorting switch during said mating, wherein said shorting switch is arranged so that when said connector and said mating connector are separated said contact end is in shorting engagement with at least two of said signal contacts and when said connector and said mating connector are mated said contact end is spaced from said signal contacts and from both of said connector housings.

2. In an electrical connector including an insulating housing having a base, at least one row of signal contacts extending upwardly form said base for mating engagement with contacts of a mating connector having a housing, said signal contacts extending through said base and terminating in leads for electrically connecting to another electrical component, a shorting switch comprising:

(a) a shank secured to said base of said connector housing and having an axis substantially parallel with the axes of said signal contacts;

(b) a first beam extending from said shank at an angle to said axis away from said signal contacts and terminating in a radiused end at least partially on one side of said axis; and (c) a second beam extending from said radiused end across said axis and terminating in a contact end positioned on the other side of said axis, said second beam including a first portion extending from said radiused end diverging away from first beam to a knee and a second portion extending from said knee and angled toward said shank to said contact end, wherein said shorting switch is arranged so that when said connector and said mating connector are separated said contact end is in shorting engagement with at least two of said signal contacts and when said connector and said mating connector are mated said contact end is spaced from said signal contacts and from both of said connector housings.

3. The connector according to claim 2 wherein said knee and said contact end are positioned so that when said connector and said mating connector are in mated engagement said knee is in engagement with the side of said housing of said mating connector and said contact end is spaced from said housing.

4. The connector according to claim 2 including an opening in said base of said connector housing arranged to interferingly receive said shank.

5. The connector according to claim 4 wherein said shank includes two spaced legs extending in cantilevered fashion away from said first beam and a dimple between said two spaced legs and said first beam extending laterally therefrom and arranged so that when said shank is forced into said opening said dimple interferingly engages a wall of said opening thereby causing said spaced legs to separate and interferingly engage end walls of said opening.

6. The connector according to claim 5 wherein said opening includes a bridge between said two spaced legs of said shank arranged so that said projection of said shank is seated against said bridge to accurately position said shank within said opening.

7. The connector according to claim 5 wherein said shank includes an outwardly extending barb that interferingly engages an end wall of said opening and when said projection causes said spaced legs of said shank to separate, said barb is further forced into interfering engagement with said end wall to secure said shank within said opening.

8. The connector according to claim 7 wherein said opening includes chamfers along the edges thereof for receiving and guiding said two spaced legs during insertion of said shank into said opening.

9. The connector according to claim 2 wherein said first beam includes a first elongated opening, one end of which is adjacent said shank and the other end of which is adjacent said radiused end and said first portion of said second beam includes a second elongated opening, one end of which is adjacent said radiused end and the other end of which is adjacent said knee, said openings arranged to approximately equalize stress between said first and second beams and said radiused end.

10. The connector according to claim 9 wherein said second portion of said second beam includes a third elongated opening having an end adjacent said knee and extending through said contact end, bifurcating said contact end thereby defining first and second spaced apart contact ends for shorting engagement with said signal contacts, said third elongated opening arranged to equalize the contact forces between said first and second contact ends and their respective said signal contacts.

11. A shorting switch for use in an electrical connector of the type including an insulating housing having a base, at least one row of signal contacts extending upwardly from said base for mating engagement with contacts of a mating connector and extending through said base and terminating in leads for electrically connecting to another electrical component, said mating connector having a housing, said shorting switch comprising:

(a) a shank arranged to be secured to said base so that its axis is substantially parallel with the axes of said signal contacts;

(b) a first beam extending from said shank at an angle to said axis in one direction away from said signal contacts and terminating in a radiused end at least partially on one side of said axis; and (c) a second beam extending from said radiused end in another direction across said axis and terminating in a contact end positioned on the other side of said axis, said second beam including a first portion extending from said radiused end diverging away from said first beam to a knee and a second portion extending from said knee and angled toward said shank to said contact end, wherein said first and second beams are arranged so that when said shank is secured to said base of said connector, and said connector and said mating connector are separated said contact end is in shorting engagement with at least two of said signal contacts and when said connector and said mating connector are mated said contact end is spaced from said signal contacts and from both of said connector housings.

12. The shorting switch according to claim 11 wherein said knee and said contact end are positioned so that when said connector and said mating connector are in mated engagement said knee is in engagement with the side of said housing of said mating connector and said contact end is spaced from said housing.

13. A shorting switch according to claim 11 wherein said base includes an opening to interferingly receive said shank and said shank includes a body and a pair of spaced apart legs extending therefrom, a dimple extending from said body lateral to and between said legs and arranged so that when said shank is inserted into said opening a portion of said body is slightly lengthened thereby forcing said legs into the end walls of said opening.

14. The shorting switch according to claim 13 wherein said shank includes a pair of outwardly extending barbs, one on each end of said body, that interferingly engage the end wall of said opening and when said dimple causes said portion of said body to lengthen, said barbs are further forced into interfering engagement with said opening to secure said shank within said opening.

15. The connector according to claim 11 wherein said first beam includes a first elongated opening, one end of which is adjacent said shank and the other end of which is adjacent said radiused end and said first portion of said second beam includes a second elongated opening, one end of which is adjacent said radiused end and the other end of which is adjacent said knee, said openings arranged to approximately equalize stress between said first and second beams and said radiused end.

* * * * *

UNITED STATES PATENT AND TRADEMARK OFFICE

CERTIFICATE OF CORRECTION

PATENT NO. : 5,470,243

DATED : Nov. 28, 1995

INVENTOR(S) : Robert L. Bendorf

It is certified that error appears in the above-identified patent and that said Letters Patent is hereby corrected as shown below: On the title page:Item [54] and Column 1, line 2, should read --ELECTRICAL CONNECTOR WITH SHORTING SWITCH--.

Signed and Sealed this

Thirtieth Day of April, 1996

*Attest:*

*Attesting Officer*

BRUCE LEHMAN

*Commissioner of Patents and Trademarks*